United States Patent [19]

Zwicker

[11] Patent Number: 4,947,589

[45] Date of Patent: Aug. 14, 1990

[54] SANDBLASTING VALVING DEVICE

[75] Inventor: Fred Zwicker, Canfield, Ohio

[73] Assignee: Truman's Inc., Ohio Corporation, Canfield, Ohio

[21] Appl. No.: 383,730

[22] Filed: Jul. 24, 1989

[51] Int. Cl.[5] ..... B24C 3/02

[52] U.S. Cl. ..... 51/410; 51/439; 251/228; 251/357

[58] Field of Search ..... 51/439, 427, 438, 410; 604/240; 361/41; 222/539, 394; 239/530; 251/228, 230, 243, 300, 364, 363, 357; 137/379, 382

[56] References Cited

U.S. PATENT DOCUMENTS

| | | | |
|---|---|---|---|
| 2,054,517 | 9/1936 | Moll . | |
| 2,099,847 | 11/1937 | Gebauer et al. | 222/394 |
| 3,618,263 | 11/1971 | Weijsenburg | 51/427 |
| 4,269,359 | 5/1981 | Neiss | 239/530 |
| 4,595,130 | 6/1986 | Berney | 222/539 |
| 4,675,020 | 6/1987 | McPhee | 604/240 |
| 4,688,143 | 8/1987 | Beard | 361/41 |

FOREIGN PATENT DOCUMENTS 1198595 7/1970 United Kingdom .

*Primary Examiner*—Frederick R. Schmidt
*Assistant Examiner*—Mark F. Frazier
*Attorney, Agent, or Firm*—Harpman & Harpman

[57] ABSTRACT

An improvement in a valving device used to dispense and control a high velocity stream of abrasive granular material intrained in a fluid stream. The valving device defines a gun configuration having a handle trigger and a movable valve element pivotally mounted to the trigger and a nozzle. The valve element is a resilient member that is advanced into sealing relation with the nozzle.

3 Claims, 2 Drawing Sheets

SANDBLASTING VALVING DEVICE

BACKGROUND OF THE INVENTION

1. Technical Field

This device relates to improvements in sandblasting nozzles and valving elements associated therewith. Sandblast nozzles dispense a controlled and directed stream of abrasive granular material intrained in a fluid stream such as air. The abrasive nature of the stream tends to erode valve sealing elements as well as nozzles requiring frequent replacement of wearable parts and quick failure of a tight efficient seal.

2. Description of Prior Art

Prior Art devices of this type have relied on a variety of different valve configurations to control the fluid flow of abrasive materials in a dispensing fluid stream, see for example U.S. Pat. No. 2,054,517, Pat. No. 2,099,847, Pat. No. 3,618,263, Pat. No. 4,269,359 and U.S. Pat. No. 1,198,595.

In U.S. Pat. No. 2,054,517 a spraying device for dampening clothes is disclosed that uses a pivoted offset angularly disposed level arm with a spray tip and a stopper. The rubber stopper forms a valve element that is engageable over an opening or jet that dispenses the water. As the lever arm is moved the stopper is pivoted out of the flow path and the end of the offset lever is positioned within the flow path diffusing the water into a spray pattern.

Pat. No. 2,099,847 shows a dispensing apparatus that is characterized by a pivoted lever arm having a rubber closure element secured on its free end engageable in sealing relation with a nozzle. The device shows a valve element mounted within a fitting on the end of the lever arm and extending outwardly therefrom.

In U.S. Pat. No. 3,618,263 a sandblasting installation is shown which has a pistol-like blasting nozzle with a lever actuated shut-off mechanism. A wear plate of tungsten carbide is attached for sealing engagement with the nozzle. The wear plate is an integral one-piece construction.

Pat. No. 4,269,359 discloses a valve construction for use with high velocity streams of abrasive granular material, typical of sandblasting. A valve element is positioned on the end of a lever arm assembly and is comprised of a cylindrical element on a support shaft. The valve element distorts on engagement with the nozzle sealing same.

In British Pat. No. 1,198,595 an improvement in a sandblasting installation is shown which corresponds to U.S. Pat. No. 3,618,263 hereinbefore described.

SUMMARY OF THE INVENTION

An improvement in a sandblasting shut-off valve that will effectively control and direct a high velocity stream of abrasive material intrained in a fluid stream. The device has a lever arm actuated resilient valve element that provides extended sealing life against a nozzle subjected to extreme wear inherent in a sandblasting environment. The valve construction deflects the abrasive effects of the stream on the resilient valve element and provides for rotatably revealing a selected portion of the valve element as wear is indicated.

DESCRIPTION OF THE PREFERRED EMBODIMENT

Figure 1:
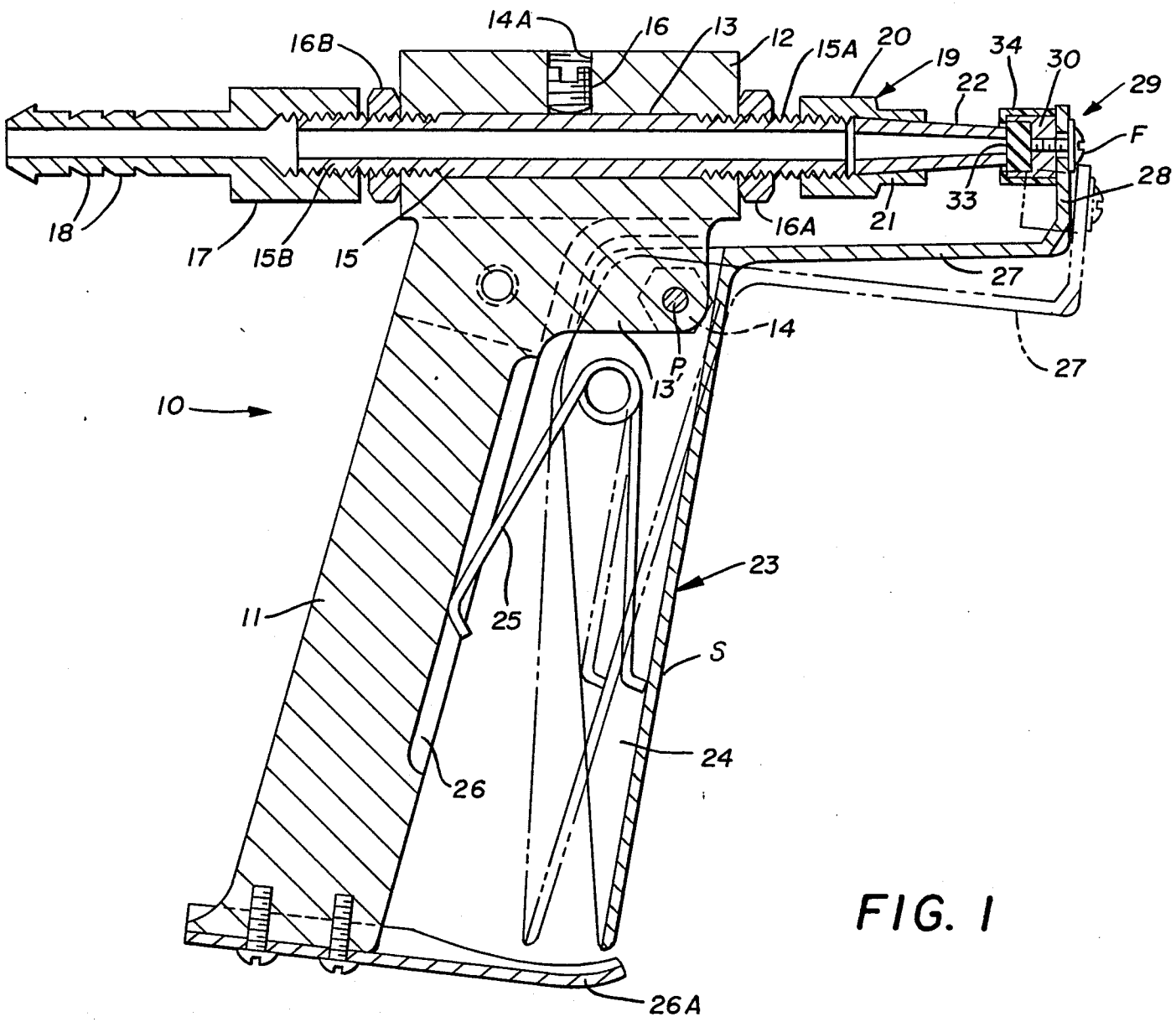
FIG. 1 is a cross-sectional view of the valving device in closed position.

A sandblasting nozzle device can be seen in FIG. 1 of the drawings for use with a typical sandblasting installation that supplies an abrasive within a high velocity stream of fluid as is well known and understood within the art. The sandblasting nozzle device of the invention comprises a main body member 10 having an angularly disposed hand grip portion 11 and a nozzle support portion 12 with a horizontally disposed bore at 13 extending through said support portion 12. A trigger support flange 13' extends from said nozzle support portion 12 and is apertured at 14. A drilled and tapped opening at 14A in the nozzle support portion 12 communicates with and is perpendicular to said horizontally disposed bore at 13 midway along its length. An elongated wear tube 15 having oppositely disposed externally threaded end portions 15A and B extends through said horizontally disposed bore at 13 and is secured within by threaded fasteners 16A and 16B on respective ends thereof engageable against the nozzle support portion 12. A set screw 16 is engaged within the opening at 14A. A supply hose fitting 17 is threadably positioned on said wear tube's 15 threaded end portion 15B and has annularly configured external hose engaging surfaces 18 as will be well known to those skilled in the art for reception and engagement of a sandblasting supply hose (not shown). A nozzle holder 19 has a threaded apertured portion 20 and a tapered nozzle engagement portion 21 to hold and engage a ceramic wear nozzle 22 on the wear tube's threaded free end 15A in communication with said wear tube.

An activation trigger assembly 23 can be seen having a tapered trigger member 24 pivotally secured to said trigger support flange 13' by a pivot pin P. The tapered trigger member 24 is generally U-shaped in cross-section providing an exterior smooth and wide gripping surface at S as well as enclosing a spring element 25. A groove 26 is formed in the surface of the hand grip portion 11 opposite said tapered trigger member 24 with the spring element 25 engaged and guided within said groove and said tapered trigger member 24 respectively.

A trigger guard 26A is secured to and extends from the free end of said handle grip portion 11 to a point just beyond and below the free end of said tapered trigger member 24.

A valve support arm 27 extends from the tapered trigger member 24 adjacent its pivot point and has an upturned portion defining a valve element mounting bracket 28 thereon.

Figure 2:
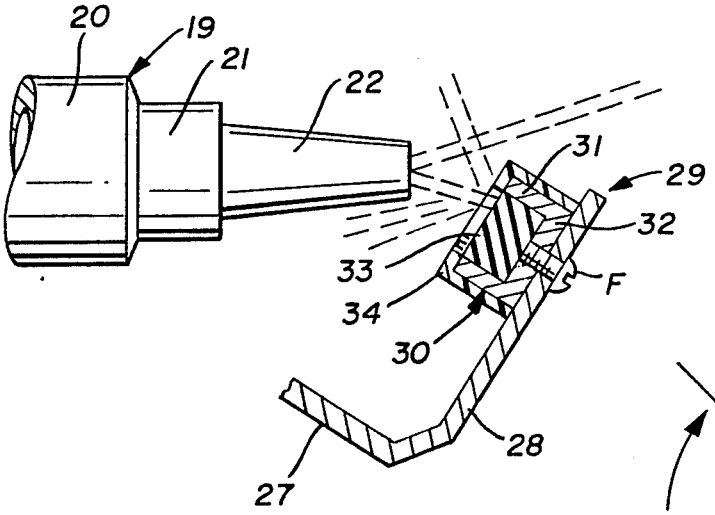
FIG. 2 is an enlarged view of a portion of the device showing a nozzle and valve element relationship in open position.

Referring now to FIGS. 1 and 2 of the drawings, a valve element assembly 29 can be seen comprising a hard metal seal holder 30 having an upstanding annular wall and an apertured base portion 32.

A resilient sealing plug 33 is affixed by adhesives within the seal holder 30 flush with and encompassed by the upstanding annular wall 31. An apertured resilient resin seal holder cap 34 is affixed over the seal holder 30 and around the resilient sealing plug 33 completing the assembly which is secured to the mounting bracket 28 by a threaded fastener F.

Figure 3:
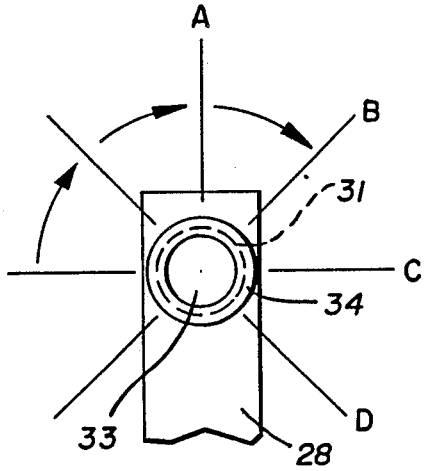
FIG. 3 is a graphic representation of the enlarged surface of the valve element illustrating rotational wear avoidance positioning thereof.
Figure 4:
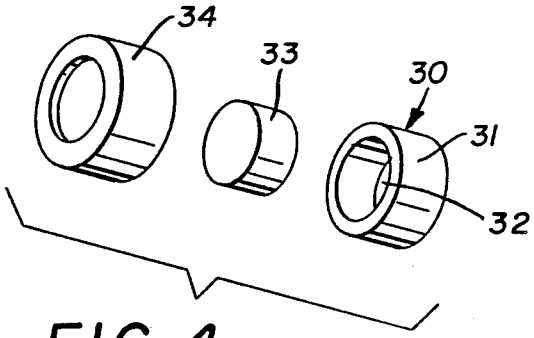
FIG. 4 is an enlarged exploded perspective view of the valve element.

In operation, the spring urged tapered trigger member 24 holds the interconnected valve element assembly 29 against the nozzle 22 as seen in FIG. 1 of the drawings. Upon activation of the tapered trigger member 24 by compression of the spring element 25 the valve support arm 27 and mounting bracket 28 move away from the nozzle 22 allowing a high volume fluid stream of intrained abrasives to exit the nozzle 22. As the valve element assembly 29 swings away or is closed it impinges on the fluid stream of abrasive as illustrated in FIG. 2 of the drawings which usually subjects valve element assembly 29 and associated resilient sealing plug to adverse accelerated wear. It is at this juncture that the wear occurs on the valve element assembly 29 with the most damage occuring on the annular edge of the seal holder 30 and sealing plug 33 which is the most critical and least supportive of the valve element assembly. It will be evident that the resilient resin seal holder cap 34 covering the edge of the annular wall 31 will at first resiliently repel the abrasive and then as it wears down provide a visual indication of that wear. Since the seal holder's annular wall 31 encompasses the resilient plug 33 and the annular wall 31 is covered by the resilient resin cap 34, the resilient plug 33 will be protected from rapid wear thus maintaining a positive seal against the nozzle 19. Once the abrasive wear has begun on the seal holder 30 it can be rotated on its central axis, a sixth of a turn at a time, through six positions indicated generally as A–G as seen on FIG. 3 extending the effective life of the resilient plug 33.

In extended use tests, it has been determined that if the seal holder 30 is rotated as hereinbefore described after approximately 1,000 on/off cycles of the device there will be no leakage and failure of the sealing plug 33 as would normally occur. Also if the resilient resin valve cap 34 is replaced on a regular basis in accordance with visual indications of wear, the on/off cycles occuring before rotation of the seal holder 30 can be extended.

As will occur in any sandblasting environment the nozzle 19 and wear tube 15 will eventually require replacement as wear occurs during use.

It is also evident from the above description that upon proper replacement of the resilient cap 34 or periodic rotation of the seal holder 30 that the continued safe, effective and required sealing nature of the device will be inherently enhanced as will be apparent to those skilled in the art.

A plurality of raised indexing marks T are positioned in spaced annular relation on said seal holder cap 34 to provide visual indexing for segmented rotation of same.

Thus it will be seen that a new and useful device has been illustrated and described and it will be apparent to those skilled in the art that various changes and modifications may be made therein without departing from the spirit of the invention, therefore I claim:

1. An improvement in a sandblasting valve device having a main body member, a grip portion and a nozzle support portion thereon, a wear tube removably positioned in said nozzle support portion, a nozzle communicating with said wear tube, a trigger on said nozzle support portion, the improvement comprising; a valve support, a valve element assembly on an end of said valve support comprising an annular seal holder having a cavity of a known diameter and depth, a resililent sealing plug of a matching diameter and depth positioned in said seal holder, a resilient apertured cap positioned over and around said seal holder exposing said resilient sealing plug therein, means for mounting said valve support on said trigger for movement toward and away from said nozzle and means for rotating said annular seal holder, sealing plug and apertured cap about its axis on said mounting means.

2. The improvement in a sandblasting valve device of claim 1 wherein said annular seal holder comprises a centrally apertured metal base, an upstanding annular wall on said metal base, said resilient sealing plug comprising a cross sectionally circular member with flat upper and lower ends positioned in said annular upstanding wall on said metal base, said resilient apertured cap comprising an annular member having an inturned annular flange on its upper end arranged to overlie and protect said upstanding annular wall of said annular seal holder and said resilient sealing plug from abrasive granular material entrained in a fluid stream discharged through said nozzle when said valve element assembly moves toward said nozzle.

3. The improvement in a sandblasting valve device of claim 1 wherein said means for rotating said valve element assembly comprises a selectively engageable fastener on said valve support.

* * * * *